United States Patent [19]

Hull et al.

[11] 3,981,054

[45] Sept. 21, 1976

[54] BURIAL CASKET WITH IMPROVED SEALING SYSTEM

[75] Inventors: George Scott Hull, Richmond; Louie V. Chaney, Centerville; Richard Dean Watson, Richmond, all of Ind.

[73] Assignee: Johnson Sheet Metal Works Corporation, Richmond, Ind.

[22] Filed: July 18, 1975

[21] Appl. No.: 597,099

[52] U.S. Cl. ..... 27/17
[51] Int. Cl.[2] ..... A61G 17/00
[58] Field of Search ..... 27/17, 6, 7, 35; 220/233, 234, 235

[56] References Cited

UNITED STATES PATENTS

| | | | |
|---|---|---|---|
| 1,965,385 | 7/1934 | Ludwig | 27/6 |
| 2,284,921 | 6/1942 | Purkiss | 27/17 |
| 2,830,354 | 4/1958 | Slaughter | 27/6 |

*Primary Examiner*—John D. Yasko
*Attorney, Agent, or Firm*—Jacox & Meckstroth

[57] ABSTRACT

The base section of a burial casket supports an internal latch mechanism which is effective to engage keepers projecting downwardly from a pivotally supported cover section and to draw the cover section firmly against a resilient gasket member disposed between the base and cover sections. The gasket member is molded as a one-piece rectangular frame and includes parallel spaced peripherally extending sealing portions, the inner portion having an inverted U-shaped wall configuration and the outer portion having generally a V-shaped wall configuration. The latch mechanism includes a rotary actuator having an externally threaded coupling portion projecting to a circular opening within the front wall of the base section. A resilient sealing ring or grommet is mounted within the opening, and a cap-like closure member includes a tubular coupling portion which projects through the opening and threadably engages the coupling portion of the rotary actuator. When the closure member is tightened, the grommet is compressed between the base section and an annular surface on the closure member. When the closure member is released, air is permitted to flow through the opening to equalize the pressure within the casket with atmospheric pressure. The closure member is also adapted to be used as a test cap during testing of the casket with pressurized air.

16 Claims, 5 Drawing Figures

BURIAL CASKET WITH IMPROVED SEALING SYSTEM

BACKGROUND OF THE INVENTION

In the construction of sealer-type burial caskets, the top or cover is commonly constructed of sheet metal in one or two sections which are pivotally supported by hinges mounted on a base section, also constructed of sheet metal. A frame-like resilient gasket is positioned between the cover section or sections and the base section, and a mechanical latch mechanism is supported within the base section. The latch mechanism is effective to engage downwardly projecting keepers on each cover section and to draw the cover downwardly for deforming or compressing the gasket member and thereby produce a substantially fluid-tight seal between the cover and base sections when the latch mechanism is actuated to its locked position. For example, U.S. Pat. Nos. 2,284,921 and 2,830,354 disclose sealer-type sheet metal caskets with such types of gaskets and latch mechanisms.

Usually, the latch mechanisms employed on sealer-type caskets, incorporate a rotary actuator which projects through a side wall or end wall of the base casket section, for example, as shown in the above patents. The projecting portion of the actuator has a hexagonal recess or socket for receiving an Allen wrench when it is desired to actuate the latch mechanism between its released and locked positions. In such caskets, it is necessary to provide some type of sealing system to provide a fluid-tight seal between the rotary actuator and the sheet meetal wall of the casket section. The above patents illustrate two different forms of such sealing systems.

In the manufacture of sheet metal caskets, it is desirable to provide for stacking the sheet metal wall and bottom panels which are used to form the base casket section before the panels are welded together, and preferably, each panel is designed so that a stack of the panels will nest together in interfitting relation. When a stack of corresponding sheet metal panels have been stacked, it is desirable to avoid any protrusion or projection from each panel in order to avoid scratching or damaging of adjacent panels when a stack of panels are being transported. Since the rotary actuators of the latch mechanisms commonly project outwardly from the side panels, the latch mechanisms are usually not mounted on the base casket section until it is constructed by welding the corresponding sheet metal panels together. However, it has been found desirable to attach the latch mechanism to the supporting sheet metal panel before the panel is welded to other panels to form the base section.

It has also been found desirable to provide for a flow of air through the latch opening when a sealer-type casket is closed, especially when the casket is being carried in an aircraft and the casket is exposed to substantial changes in atmospheric pressure. To provide both the feature of forming a fluid-tight seal at the latch opening and also the feature of selectively permitting air to flow through the latch opening, has previously required a relatively complicated seal forming structure, for example, such as shown in above mentioned U.S. Pat. No. 2,284,921.

SUMMARY OF THE INVENTION

The present invention is directed to a sealer-type burial casket which incorporates an improved and simplified system for sealing the casket sections to provide a fluid-tight seal. That is, the invention provides for an improved closure and sealing system for the latch opening and also an improved gasket member for forming a fluid-tight seal between the cover and base sections of the casket when the cover section is closed and latched. The closure and sealing system for the latch opening also permits the installation of the latch mechanism onto a side panel of the base section before the base section is formed by welding the side, end and bottom panels together.

In accordance with a preferred embodiment of the invention, the above features are provided by a latch mechanism which incorporates a rotary actuator having an externally threaded coupling portion which is aligned axially with a circular latch opening within the base casket section. A resilient grommet is mounted within the latch opening and is connected by a flexible chain to a cap or closure member which includes an internally threaded tubular coupling portion for engaging the coupling portion of the rotary latch actuator. When the closure member is assembled, the tubular coupling portion projects through the latch opening, and the enlarged head portion of the closure member seats against the resilient grommet to form a fluid-tight closure for the latch opening. When the closure member is partially unthreaded or released, means are provided to permit a small flow of air through the latch opening for pressure equalization. One of the closure members may also be provided with a center opening and an air passage so that it may be used as a test cap when a closed casket is pressure tested for leaks.

The improved sealing system of the invention also incorporates an improved resilient gasket member which extends between the base and cover sections of the casket. The gasket member incorporates an inner peripherally extending hollow rib portion having an inverted U-shaped wall configuration and an outer parallel spaced and peripherally extending flexible lip portion having a generally V-shaped cross-sectional configuration. The improved gasket member assures a positive fluid-tight seal between the casket sections when the cover section is closed and latched.

DESCRIPTION OF THE PREFERRED EMBODIMENT

Figure 1:
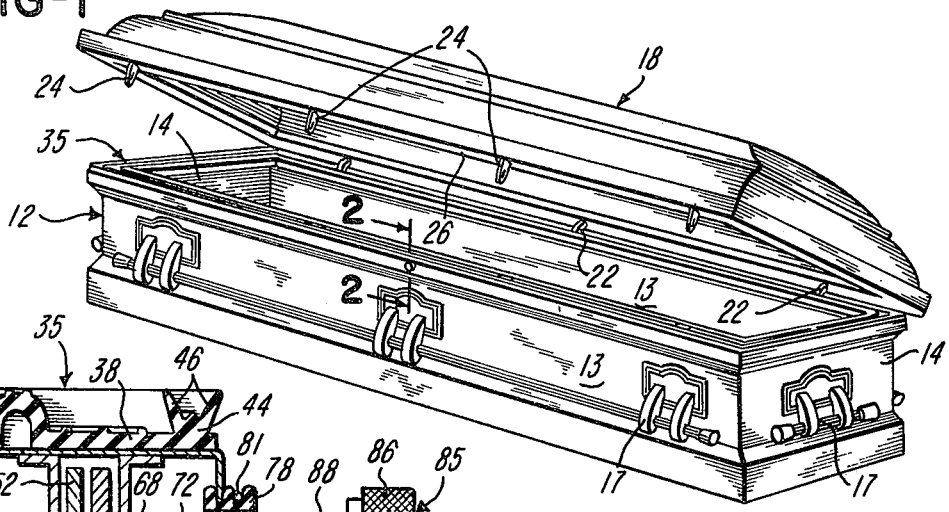
FIG. 1 is a perspective view of a sheet metal sealer-type burial casket before the lining is installed and with the covere section shown in a partially open position.
Figure 2:
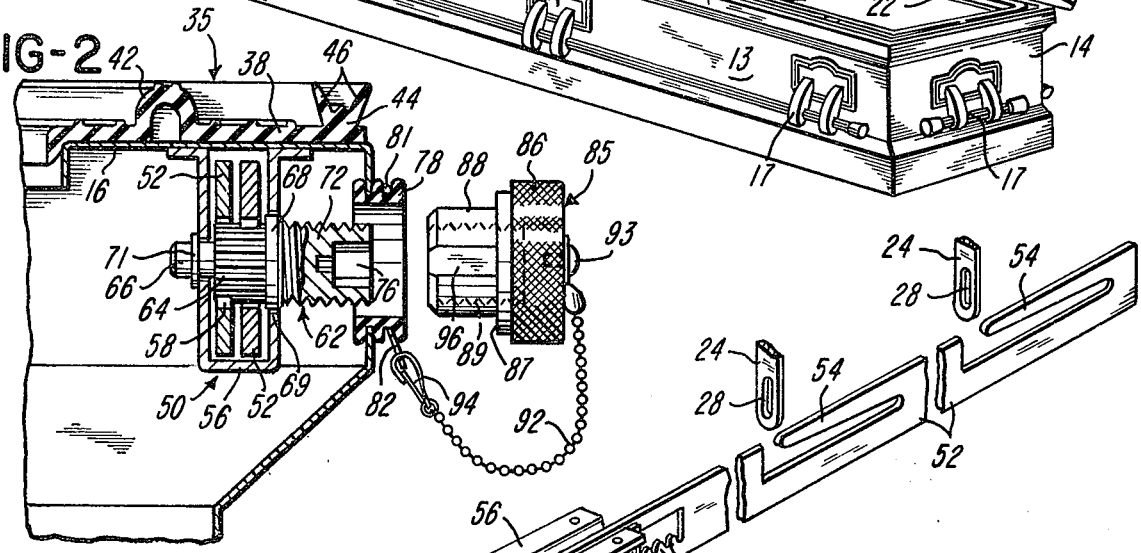
FIG. 2 is an enlarged fragmentary section taken generally on the line 2—2 of FIG. 1 and showing the closure and sealing system for the latch mechanism.

In reference to FIG. 1, a sealer-type sheet metal casket is illustrated without the internal padding and lining materials and generally includes an elongated box-like base section 12 formed by a set of sheet metal side panels 13, end panels 14 and a bottom panel (not shown). The panels are continuously welded together to form a fluid-tight enclosure or container and form a peripherally extending frame-like upper planar wall 16 (FIG. 2). A set of handle members 17 are secured to the side and end panels 13 and 14 in a conventional manner. A rectangular top or cover section 81 is also constructed of sheet metal and is pivotally supported by a series of hinges 22 for movement between an upwardly or vertically projecting open position and a horizontal closed position. A series of stud-like keeper elements 24 are rigidly secured to a frame-like planar bottom wall 26 of the cover section 18 and project downwardly at longitudinally spaced intervals along the outer or front edge of the cover section. Each of the keeper elements 24 is provided with a slot 28 (FIG. 3) and is adapted to project through a corresponding opening of hole within the top wall 16 of the base section 12.

In accordance with the present invention, a one piece rectangular gasket member 35 is mounted on the upper wall 16 of the base section 12 and is molded in an injection molding machine from a rubber-like resilient material so that the parallel side portions and the parallel end portions of the gasket member are all integrally connected. The gasket member 35 includes a generally flat base wall 38, and projecting upwardly from the base wall 38 is a first or inner gasket portion 42 which extends completely around the periphery of the gasket member 35. The inner gasket portion 42 is molded in the form of a hollow rib with an inverted U-shaped wall configuration in lateral cross-section. The gasket member 35 also includes a second or outer gasket portion 44 which extends parallel to the inner gasket portion 42 and includes a pair of upwardly projecting and diverging flexible wings or lips 46 forming a generally V-shaped wall configuration in lateral cross-section.

Figure 3:
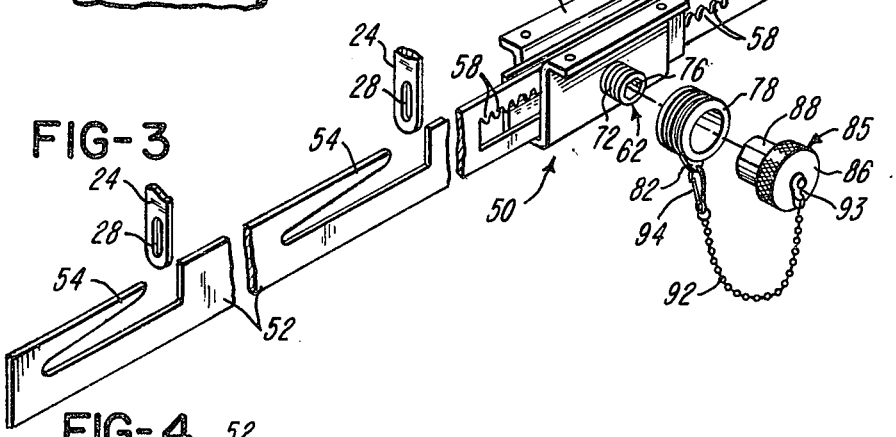
FIG. 3 is a fragmentary and partially exploded view of the latch mechanism components and the closure system shown in FIG. 2.

In reference to FIGS. 2 and 3, a latch mechanism 50 includes a pair of elongated metal strap-like locking members 52 each of which has a set of notches within its upper edge surface to form a corresponding set of tapered cam or key portions 54. The locking members 52 extend longitudinally under the front upper wall 16 of the base section 12, and the inner end portions of the locking members 52 are slidably supported by a generally U-shaped sheet metal bracket 56 which is rigidly secured to the underneath surface of the front upper wall 16, preferably by spot welds or rivets. The laterally overlapping inner end portions of the locking members 52 are formed with slots which define linear gear or rack teeth 58 on the upper portion of one locking member 52 and on the lower portion of the other locking member. The tapered key portions 54 are adapted to project into the slots 28 of the corresponding keeper elements 24 when the locking members 52 are shifted longitudinally from their released positions (FIG. 3) to their locking positions (not shown) after the cover section 18 is closed.

The latching mechanism 50 also incorporates a rotary actuator 62 (FIG. 2) which includes a pinion 64 projecting through the slots within the inner end portions of the locking members 52 and engaging the upper and lower rack teeth 58. An integral stub shaft 66 projects from the pinion 64 through a circular opening within the bracket 56 for rotatably supporting the inner end portion of the rotary actuator 62. A larger cylindrical bearing surface 68 is formed on an intermediate portion of the rotary actuator 62 and is rotatably supported within a larger circular opening 69 also formed within the bracket 56. A C-shaped retaining ring 71 surrounds the inner stub shaft 66 to retain the rotary actuator 62 within the bracket 56.

Thee rotary actuator 62 further includes an externally threaded coupling portion 72 which projects cantileveredly from the bracket 56 and is aligned axially with a circular latch actuator opening 74 formed within the upper portion of the front side wall 13 of the base casket section 12. The outer end surface of the coupling portion 72 terminates substantially flush with the outer surface of the sheet metal side panel 13 and is provided with a hexagonal recess 76 for receiving an Allen-type latch actuating wrench (not shown).

The coupling portion 72 of the rotary latch actuator 62 is surrounded by a resilient fluid sealing washer or annular grommet 78 which projects through the opening 74 and snap-fits onto the front sheet metal side panel 13. The grommet 78 has two peripherally extending grooves. The inner groove receives the front side panel 13, and the outer groove receives a sheet metal washer 81 having a projecting tang 82.

A cap or closure member 85 includes a cylindrical gripping portion 86 having a knurled outer surface and forming an annular radial shoulder or surface 87. The closure member 85 also includes a tubular coupling portion 88 which has an outer cylindrical surface with a diameter slightly less than the inside diameter of the grommet 78. The coupling portion 88 has an internally threaded bore 89 for receiving the externally threaded coupling portion 72 of the rotary latch actuator 62 when the closure member 85 is screwed onto or attached to the coupling portion 72.

When the closure member 85 is tightened, the annular surface 87 presses against the grommet 78 and forms a fluid-tight seal between the closure member 85 and the adjacent front panel 13 of the base casket section 12. A flexible chain 92 has one end connected to the center of the closure member 85 by a swivel connection 93, and the opposite end of the chain 92 is connected by a snap hook 94 to the tab 82 of the retaining washer 81. Thus when the closure member 85 is completely removed from the rotary actuator coupling portion 72 to provide for actuating the latch mechanism 50, the closure member 85 will remain attached to the casket.

As shown in FIG. 2, a flat surface 96 is formed on the tubular coupling portion 88 of the closure member 85 and provides for an air flow through the latch opening 74 when the closure member 85 is partially released. The partial release of the closure member is desirable when the sealed casket is being transported by an aircraft and it is necessary to equalize the air pressure within the sealed casket with the air pressure of the surrounding atmosphere.

Figure 5:
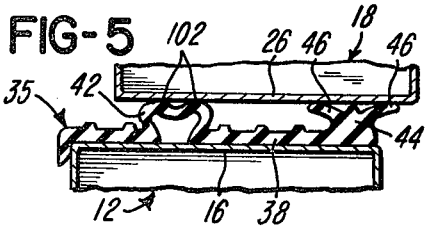
FIG. 5 is an enlarged fragmentary section illustrating the configuration of the sealing gasket when the cover section is closed and latched to the base section of the casket.

In reference to FIG. 5, when the cover section 18 is closed, and the latch mechanism 50 is operated to its latched or locked position, the cover section 18 is drawn downwardly toward the base section 12 so that the gasket member 35 is compressed substantially uniformly between the opposing frame-like walls 16 and 26 of the respective casket sections 12 and 18. The deformation or compression of the inner hollow rib gasket portion 42 is effective to provide a concentrated pressure along the dual contact areas or ridges 102 to provide an inner fluid-tight seal between the casket sections 12 and 18. As also shown in FIG. 5, when the gasket member 35 is compressed, the outer wings or lips 45 flex outwardly to form generally a suction-type seal extending continuously around the entire periphery of the casket section and thereby form an outer fluid-tight seal.

Figure 4:
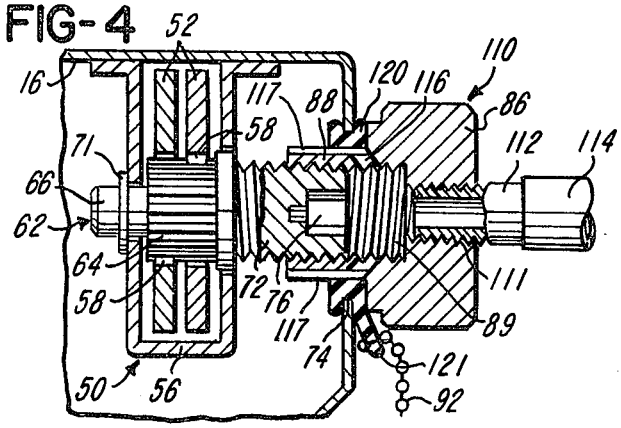
FIG. 4 is a fragmentary section similar to FIG. 2 and showing the assembly of a closure member which is modified to form a pressure testing cap.

Referring to FIG. 4, a cap or closure member 110 has a configuration the same as the closure member 85, and accordingly, the corresponding reference numbers are used to refer to the common structure. In addition, the closure member 110 includes an axially extending threaded opening 111 which receives a tubular fitting 112. A flexible hose 114 connects the fitting 112 to a pressurized air supply or to a vacuum source when it is desired to pressurize or evacuate the closed casket sections during testing of the casket for fluid leaks. A set of diametrically opposed passages or ports 116 extend from the internally threaded bore 89 to a corresponding pair of grooves 117 which extend axially within the outer surface of the tubular coupling portion 88. The ports 116 and grooves 117 permit the air to flow freely from the air supply tube 114 into the chamber defined by the casket sections when the cover section 18 is closed. In place of the grommet 78 which has a pair of axially spaced peripheral grooves, a resilient grommet 120 is mounted within the opening 74, and the grommet 120 includes an integrally molded projecting tab 121 which retains the corresponding end portion of the flexible chain 92. Thus it is apparent that the grommet 120 is interchangeable with the grommet 78 and may be used in place of the grommet 78.

From the drawing and the above description, it is apparent that a sealer-type casket incorporating a sealing system constructed in accordance with the present invention, provides desirable features and advantages. For example, the coupling portion 72 of the rotary latch actuator 62 cooperates with the grommet 78 and the coupling portion 88 of the closure member 85 to provide a simplified means for forming a conveniently releasable fluid-tight closure for the latch opening 74. That is, the grommet 78 or 120 may be quickly mounted or snap-fitted into the opening 74 and provides a simplified structure for obtaining not only a fluid-tight seal between the closure member 85 and the rotary latch actuator 62 but also a fluid-tight seal between the closure member 85 and the adjacent sheet metal panel of the base casket section 12.

Another important feature is that the rotary actuator 62 does not project outwardly from the adjacent side panel 12 and thus provides for nesting of a stack of side panels 13 after a latch mechanism 50 is attached to each side panel. In addition, the construction of the gasket member 35 with the parallel gasket portions 42 and 44 extending around the periphery of the casket sections, provide another desirable feature. That is, it has been found that the deformation or compression of the hollow rib-type gasket portion 42 cooperates with the flexing of the wing-type gasket portion 44 to assure that a substantially fluid-tight seal is formed between the casket sections 12 and 18 when the cover section 18 is closed and latched. As also mentioned above in connection with FIG. 4, the closure member 85 may be easily modified so that it may be used for testing an assembled casket with pressurized air.

While the form of burial casket and fluid sealing system herein described constitutes a preferred embodiment of the invention, it is to be understood that the invention is not limited to the precise form of structure shown, and that changes may be made therein without departing from the scope and spirit of the invention as defined in the appended claims.

The invention having thus been described, the following is claimed:

1. A burial casket comprising a base section supporting a cover section for pivotal movement between an open position and a closed position, a resilient gasket member disposed between said base section and said cover section, a latch mechanism for drawing said cover section firmly toward said base section to compress said gasket member therebetween, said latch mechanism including a rotary actuator positioned generally adjacent an opening within one of said casket sections, means for rotating said actuator to effect movement of said latch mechanism between a released position and a latched position, said rotary actuator including a coupling portion projecting generally in axial alignment with said opening, a closure member for said opening and including an annular surface adjacent a coupling portion projecting axially through said opening, means for releasably securing said coupling portion of said closure member to said coupling portion of said rotary actuator, a sealing ring positioned adjacent said opening and surrounding said coupling portion of said closure member, and said sealing ring forms a substantially fluid-tight seal between said annular surface of said closure member and said one section of said casket.

2. A burial casket as defined in claim 1 wherein said coupling portion of said rotary actuator has external threads, and said coupling portion of said closure member is tubular and has internal threads for receiving said coupling portion of said rotary actuator.

3. A burial casket as defined in claim 1 including a bracket member mounted on the inner surface of said one casket section and having means for rotatably supporting said rotary actuator, and said coupling portion of said rotary actuator projects cantileverly from said bracket member and terminates generally adjacent said opening within said one casket section.

4. A burial casket as defined in claim 1 whererin said sealing ring comprises a resilient grommet positioned within said opening, and said grommet has an inner diameter of sufficient size to receive said coupling portion of said closure member.

5. A burial casket as defined in claim 4 including an elongated flexible link member having one end portion connected to said grommet and an opposite end portion connected to said closure member to provide for retaining said closure member with said casket sections when said closure member is removed from said coupling portion of said rotary actuator.

6. A burial casket as defined in claim 1 wherein said gasket member comprises a first deformable gasket portion and a second deformable gasket portion extending in parallel spaced relation substantially around the periphery of said casket sections, said first portion has a generally U-shaped wall in lateral cross-section, and said second portion has a plurality of flexible lips disposed to form generally a V-shaped cross-sectional configuration to effect a positive fluid-tight seal between said casket sections when said cover section is in said closed position.

7. A burial casket as defined in claim 6 wherein said gasket member comprises a one-piece molded rectangular frame, and said first and second gasket portions extend completely around the periphery of said base casket section.

8. A burial casket as defined in claim 6 wherein said gasket member is mounted on said base section of said casket, said first gasket portion has an inverted U-shaped wall configuration in lateral cross-section, and said second gasket portion has generally a V-shaped configuration in lateral cross-section.

9. A burial casket as defined in claim 1 wherein said closure member includes means defining an axially extending air opening adapted to be connected to a supply of pressurized air to provide for testing the air pressure retention of said casket sections when said cover section is in said closed position and said latch mechanism is in said latched position.

10. A burial casket as defined in claim 9 wherein said closure member further includes means defining an air passage extending from said opening to the outer surface of said coupling portion of said closure member to provide for a direct flow of pressurized air through said closure member into said casket sections.

11. A burial casket as defined in claim 1 wherein the outer surface of said coupling portion of said closure member defines an axially extending recess to provide for a flow of air through said opening when said closure member is partially released from said actuator member and said sealing ring.

12. A burial casket comprising a base section supporting a cover section for pivotal movement between an open position and a closed position, a resilient gasket member disposed between said base section and said cover section, a latch mechanism for drawing said cover section firmly toward said base section to compress said gasket member therebetween, said latch mechanism including a rotary actuator positioned generally adjacent an opening within one of said casket sections, means for rotating said actuator to effect movement of said latch mechanism between a released position and a latched position, means for releasably securing said closure member to said one casket section, a sealing ring positioned adjacent said opening and adjacent said closure member, said sealing ring forming a substantially fluid-tight seal between said closure member and said one section of said casket, said gasket member includes a first deformable gasket portion and a second deformable gasket portion extending in parallel spaced relation substantially around the periphery of said casket sections, said first portion has a generally U-shaped wall in lateral cross-section, and said second portion has a plurality of flexible lips disposed to form generally a V-shaped cross-sectional configuration to effect a positive fluid-tight seal between said casket sections when said cover section is in said closed position.

13. A burial casket as defined in claim 12 wherein said gasket member comprises a one-piece molded rectangular frame, and said first and second gasket portions extend completely around the periphery of said base casket section.

14. A burial casket as defined in claim 12 wherein said gasket member is mounted on said base section of said casket, said first gasket portion comprises a hollow rib having an inverted U-shaped wall configuration in lateral cross-section, and said flexible lips diverge in an upward direction.

15. A burial casket comprising a sheet metal base section supporting a sheet metal cover section for pivotal movement between an open position and a closed position, a resilient gasket member disposed between said base section and said cover section, a latch mechanism for drawing said cover section firmly toward said base section to compress said gasket member therebetween, said latch mechanism including a rotary actuator positioned generally adjacent an opening within said base casket section, means for rotating said actuator to effect movement of said latch mechanism between a released position and a latched position, said rotary actuator including a coupling portion having external threads and projecting cantileverly in substantial axial alignment with said opening, a closure member for said opening and including an annular surface adjacent a tubular coupling portion projecting axially through said opening, said tubular coupling portion having internal threads for releasably securing said coupling portion of said closure member to said coupling portion of said rotary actuator, a resilient grommet positioned within said opening and surrounding said tubular coupling portion of said closure member, and said grommet forms a substantially fluid-tight seal between said annular surface of said closure member and said base section of said casket.

16. A burial casket as defined in claim 15 wherein said gasket member comprises a first deformable gasket portion and a second deformable gasket portion extending in parallel spaced relation substantially around the periphery of said casket sections, said first portion has a generally U-shaped wall in lateral cross section, and said second portion has a plurality of flexible lips disposed to form generally a V-shaped cross-sectional configuration to effect a positive fluid-tight seal between said casket sections when said cover section is in said closed position.

* * * * *